US005238372A

United States Patent [19]

Morris

[11] Patent Number: 5,238,372

[45] Date of Patent: Aug. 24, 1993

[54] COOLED SPOOL PISTON COMPRESSOR

[75] Inventor: Brian G. Morris, Houston, Tex.

[73] Assignee: The United States of America as represented by the Administrator of the National Aeronautics and Space Administration, Washington, D.C.

[21] Appl. No.: 998,062

[22] Filed: Dec. 29, 1992

[51] Int. Cl.[5] ..... F04B 35/00

[52] U.S. Cl. ..... 417/393; 417/404

[58] Field of Search ..... 417/393, 401, 402, 403, 417/404, 263, 264, 267

[56] References Cited

U.S. PATENT DOCUMENTS

| | | | |
|---|---|---|---|
| 129,631 | 7/1872 | Waring . | |
| 2,042,673 | 6/1936 | Maniscalco | 230/211 |
| 2,152,054 | 3/1939 | Johnson | 230/208 |
| 2,211,029 | 8/1940 | Robinson | 230/213 |
| 3,256,835 | 7/1966 | Kraus . | |
| 4,761,118 | 8/1988 | Zanarini | 417/393 |
| 4,927,335 | 5/1990 | Pensa | 417/393 |

FOREIGN PATENT DOCUMENTS

| | | | |
|---|---|---|---|
| 2017223 | 10/1979 | United Kingdom | 417/404 |
| 2150646 | 7/1985 | United Kingdom | 417/404 |

*Primary Examiner*—Richard A. Bertsch

*Assistant Examiner*—Alfred Basichas

*Attorney, Agent, or Firm*—Hardie R. Barr; Guy M. Miller; Edward K. Fein

[57] ABSTRACT

A hydraulically powered gas compressor receives low pressure gas and outputs a high pressure gas. The housing of the compressor defines a cylinder with a center chamber having a cross-sectional area less than the cross-sectional area of a left end chamber and a right end chamber, and a spool-type piston assembly is movable within the cylinder and includes a left end closure, a right end closure, and a center body that are in sealing engagement with the respective cylinder walls as the piston reciprocates. First and second annular compression chambers are provided between the piston enclosures and center housing portion of the compressor, thereby minimizing the spacing between the core gas and a cooled surface of the compressor. Restricted flow passageways are provided in the piston closure members and a path is provided in the central body of the piston assembly, such that hydraulic fluid flows through the piston assembly to cool the piston assembly during its operation. The compressor of the present invention may be easily adapted for a particular application, and is capable of generating high gas pressures while maintaining both the compressed gas and the compressor components within acceptable temperature limits.

23 Claims, 2 Drawing Sheets

COOLED SPOOL PISTON COMPRESSOR

ORIGIN OF THE INVENTION

The invention described herein was made by an employee of the United States Government and may be manufactured and used by or for the Government of the United States of America for governmental purposes without the payment of any royalties thereon or therefor.

FIELD OF THE INVENTION

The present invention relates to gas compressors, and more particularly relates to a spool-type piston gas compressor linearly movable within a compressor housing in response to liquid pressure and capable of producing high compression ratios and displacements.

BACKGROUND OF THE INVENTION

Improvements in gas compressors have been occurring for decades, and various types of cost-effective gas compressors are manufactured today that are suitable for obtaining compression ratios of 10:1 or less. In many applications, those relatively low compression ratios are satisfactory, and if higher compression pressures are desired, conventional compressors may be placed in series. These conventional compressors generally tend to intermittently increase the temperature of the gas being compressed, but the temperature of both the compressor and the gas may be maintained within acceptable limits due to the low compression ratios.

In other applications, compression ratios greater than 10:1 are desired from a single compressor. Conventional compressors are frequently bulky, and placing compressors in a series to obtain a desired pressure may not be practical due to size and/or weight limitations. In outer space applications, for example, high gas pressures are desirably output from a relatively small and lightweight compressor. In other applications, the operating temperature of the compressor components and/or the gas being compressed must be carefully controlled, even when a high compression ratio is desired. When oxygen is being compressed, for example, its temperature must be carefully regulated throughout the compression cycle to ensure safety.

Compressors may be initially classified as a function of their driving source. Mechanically driven compressors include a reciprocating rod to drive a piston with respect to a cylinder, although the rod itself may be powered or moved from any number of conventional electric, hydraulic, or mechanical power sources. Fluid-driven compressors, on the other hand, generally drive a piston with respect to a compressor cylinder by fluctuating the liquid pressure acting on the face of the piston. Fluid-powered compressors are frequently connected to a pressurized hydraulic source, and are sometimes referred to as being hydraulically powered compressors. Although various gases or liquids may be used to reciprocate the piston with respect to the cylinder, oil is a preferred hydraulic fluid for many applications. Hydraulically powered compressors are desired for many applications, since a hydraulic power supply may otherwise be present at a plant, job site, spacecraft, or other location desiring compressed gas, so that a separate source for powering the compressor need not be provided. For many applications, fluid-driven compressors thus provide substantially increased versatility and portability over mechanically driven compressors, which generally require a separate power source.

Hydraulically powered gas compressors may be generally classified as (1) diaphragm compressors, (2) rotary compressors, and (3) piston compressors. Diaphragm compressors utilize a diaphragm that flexes within the elastic limit of the diaphragm material in response to a change in fluid pressure on one side of the diaphragm to compress a gas on the other side of the diaphragm. Conventional suction and exhaust check valves are utilized to pass the gas through the compressor, and the compressor stroke is relatively low due to the necessity to remain within the elastic limit of the diaphragm. Diaphragm compressors have a relatively large compressor hardware-surface to gas-volume ratio, which makes the compressors well suited for maintaining both the compressed gas and the compressor components within acceptable temperature limits. While compressor displacement can be increased by increasing the diameter of the diaphragm, large displacement diaphragm compressors become very massive and impractical. The diaphragm itself is comparatively short-lived due to stresses imposed on the diaphragm during each compression cycle as it flexes to displace the gas. Rotary compressors (sometimes called blowers) have high volumeric through-put, but like diaphragm compressors have comparatively low compression ratios. Neither diaphragm compressors nor rotary compressors are thus generally suitable for generating compression ratios greater than 10:1.

Conventional piston compressors are similar in configuration to an internal combustion engine, although movement of the piston is used to compress a gas rather than to power a rod and rotate a shaft. Although there is no combustion process occurring in a gas compressor, heat is nevertheless generated due to the adiabatic compression of the gas to a higher pressure state. In relatively low ratio compressors, cooling is conventionally provided for the compressor cylinder and head, but not for the compressor piston. In order to minimize peak gas temperature in conventional piston compressors, the compression ratio is thus generally maintained at 10:1 or less for any particular piston and cylinder arrangement, and multiple stages or series arrangements with intercooling may be used to achieve higher overall compression ratios. When larger displacements or higher compression ratios are attempted with conventional piston compressors designs, the increase in the cylinder diameter or piston stroke causes the temperature of the core gas at the geometric center of the gas volume to substantially increase. Since gas at this geometric center of the gas volume is spaced further from the piston, cylinder wall, and head surfaces than gas elsewhere in the compression chamber, this gas is cooled less than gas outward of this geometric center. Increased temperature of the core gas allows undesirable chemical reactions and decomposition of the compressor materials, which destroys the compressor. Also, the increase of the core gas temperature may result in unsafe and/or undesirable reactions of the gas being compressed. Accordingly, compression ratios for conventional piston compressors are maintained at safe levels generally below 10:1, while cooling is provided primarily for the compressor cylinder and head.

People familiar with piston gas compressors have recognized their significant limitations for over a century. U.S. Pat. No. 129,631 to Waring discloses a double-acting piston and cylinder compressor, which has a reciprocating drive shaft powered by an external source and a disk-shaped hollow piston moved by the shaft within the cylinder. Suction and discharge valves are located at the cylinder ends, and the compressor is internally and externally cooled and lubricated by water or other coolant. U.S. Pat. No. 2,211,029 to Robinson discloses a pump with a hollow piston for piston cooling. U.S. Pat. No. 3,256,835 to Kraus discloses a hand operated pump with specialty valving to regulate fluid flow. None of these patents disclose a hydraulically driven gas compressor.

Various attempts have been made to devise gas compressors that avoid some of the prior art problems. One design concept utilizes a compressor with a stationary piston and a sliding cylinder, rather than a stationary cylinder and reciprocating piston. U.S. Pat. No. 2,042,673 to Maniscalco discloses a compressor with a plurality of sliding cylinders operating at multiple stages, with a stationary piston in each stage. The cylinders are mechanically driven, and the piston is internally cooled by a coolant, although in this case the cylinders are not liquid cooled. U.S. Pat. No. 2,152,054 to Johnson discloses a similar gas compressor that has two sliding cylinders operating as first and second stages about respective stationary first and second pistons. The cylinders are mechanically driven. The first stage piston is cooled by a flowing coolant, although the cylinders are not cooled. None of these patents discloses a hydraulically driven gas compressor. Devices of this latter type are not particularly practical for many compressor applications, and gas compressors with stationary pistons and sliding cylinders have had little marketplace acceptance.

The disadvantages of prior art gas compressors are overcome by the present invention, and an improved gas compressor is hereinafter disclosed. The gas compressor of the present invention is hydraulically driven to reciprocate a spool-type piston within a compressor cylinder, and both the cylinder and piston may be cooled to achieve reliable operation while providing for relatively high compression ratios. The gas compressor of the present invention is relatively simple in concept and thus reliable, yet its design allows for easy modification so that the compressor size and piston stroke can be easily regulated to match a particular application.

SUMMARY OF THE INVENTION

A suitable embodiment of a gas compressor according to this invention includes a spool-type piston movable within a cylinder defined by a compressor housing. The piston preferably has a head or closure member at each end that has a diameter greater than a central portion of the piston body, and each head has a face exposed to fluctuating fluid pressure to reciprocate the piston within the cylinder. The center body of the housing similarly has a bore smaller than the bore at the cylinder ends, which are sized to receive the larger diameter piston heads. The annular space between each piston head and the cylinder wall that extends to the smaller diameter bore defines the compression chambers, which each have a suction port, a discharge port, and respective check valves. The piston is hollow, and a passageway through each piston head provides for cooling of the piston.

The compressor of the present invention can be connected to flow lines to operate as a single stage compressor, with both annular cavities taking suction from a common source and discharging high pressure gas to a single source. Alternatively, the compressor can be connected to flow lines to operate as a two-stage compressor, with the input of the first annular cavity connected to a low pressure source, the discharge from that cavity connected to the input of the second annular cavity, and the output from the second annular cavity discharged to a high pressure line. In either case, hydraulic pressure that is used to reciprocate the piston within the cylinder is maintained at a pressure less than the highest gas pressure due to the area difference between the effective piston surfaces. The same fluid that acts upon the face of the piston head and reciprocates the piston within the cylinder passes through a restricted passageway within each cylinder head and is thus used to cool the piston. The compressor housing may be cooled in a conventional manner by the same or another coolant.

It is an object of the present invention to provide an improved piston gas compressor that is hydraulically driven and includes provisions for effective cooling of the piston. The hydraulic fluid used to reciprocate the piston may be passed through the piston during the piston stroke. It is a further object of the present invention to provide a relatively simple yet highly reliable piston gas compressor that can provide for comparatively high compression ratios, and which can also be easily modified to match a specific application.

It is a feature of the present invention that the compressor maintains maximum gas temperatures within a safe limit while allowing for high compression ratios, so that the compressor may be reliably used with reactive gases. The compressor of the present invention obtains high compression ratios from a relatively small, highly reliable, and lightweight compressor design, which is ideally suited for various applications wherein a hydraulically powered fluid is readily available.

It is an advantage of the present invention that high gas pressure may be achieved with the compressor of this invention, although the generated gas pressure preferably is always greater than hydraulic fluid pressure to reduce the likelihood of gas contamination by the hydraulic fluid. The flow of hydraulic fluid through the piston increases as gas pressure increases due to the additional hydraulic pressure used to reciprocate the piston, so that coolant flow is effectively self-regulating. The design of the compressor may be easily altered to provide a high hardware-surface to gas-volume ratio to maintain relatively low gas temperatures during compression, and to minimize the distance from the core gas to a cooled compression component surface.

These and further objects, features, and advantages of the present invention will become apparent from the following detailed description, wherein reference is made to the figures in the accompanying drawings.

DETAILED DESCRIPTION OF THE PREFERRED EMBODIMENTS

Figure 1:
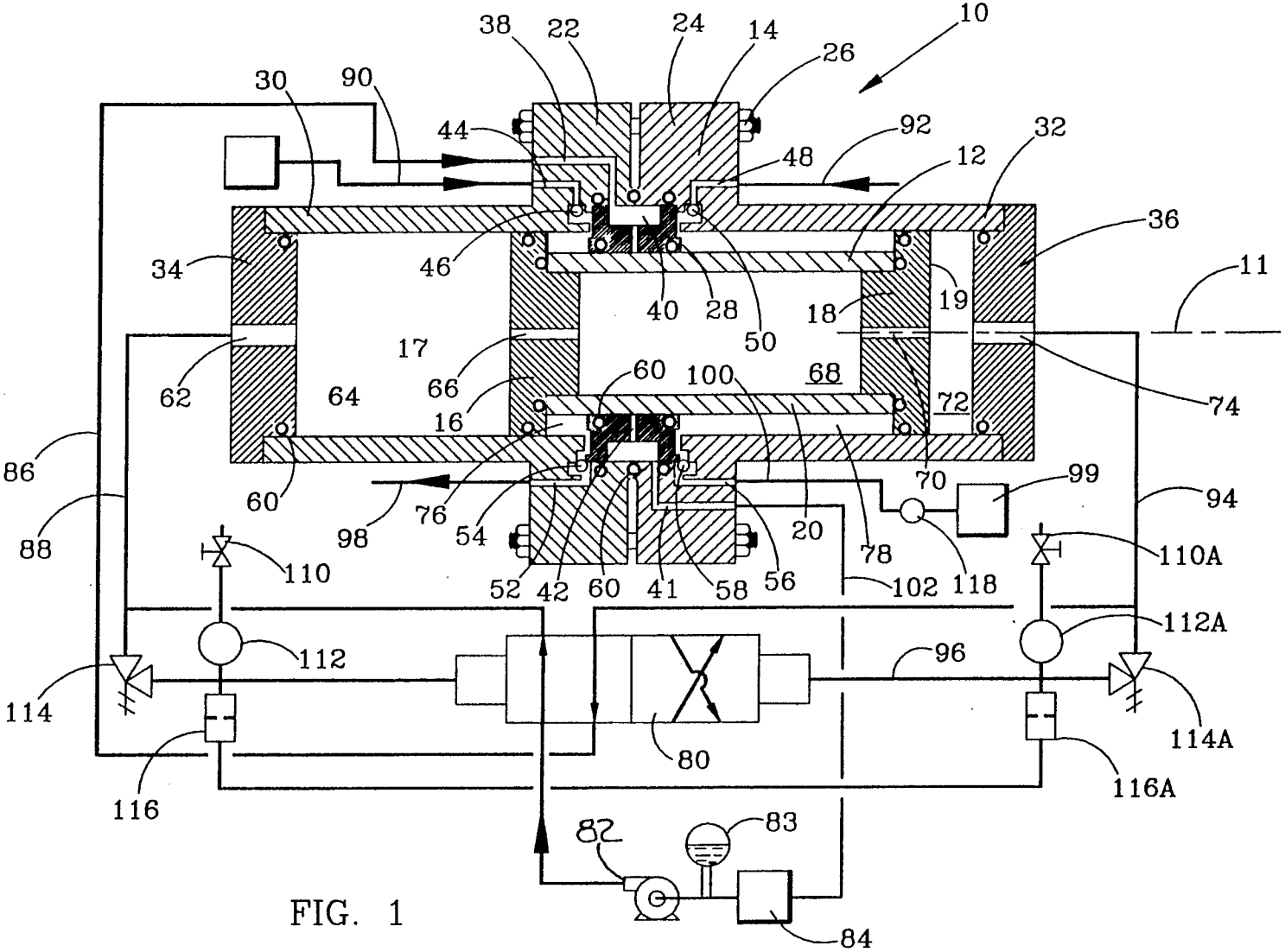
FIG. 1 is a pictorial view of one embodiment of a compressor system according to the present invention, illustrating the compressor in cross-section and schematically depicting the remaining system components.

FIG. 1 depicts one embodiment of a gas compressor according to this invention. The gas compressor is hydraulically powered, and includes a spool-type piston axially movable within a cylinder defined by the compressor housing. The compressor of this invention is relatively simple in design, achieves two compression strokes per cycle, and is easily adaptable for either single-stage or two-stage compression. The compressor design enables the compressor to be easily modified for a particular application. Both the piston and the cylindrical housing are preferably cooled during operation, and the space between the core gas at the geometric center of the compressed gas volume and a cooled surface is reduced. Since both the housing and piston are cooled, the compressor may be reliably used in applications wherein the temperature of either or both the compressor components and the compressed gas must be closely regulated.

The gas compressor 10 comprises a piston assembly 12 and a compressor body 14. The piston assembly includes a left side piston head or end closure 16, a right side piston head or end closure 18, and a sleeve-shaped center body 20. The compressor housing 14 comprises a left body member 22 and a right body member 24 that are conveniently bolted together by a plurality of circumferentially spaced bolt and nut assemblies 26. It should be understood that the compressor 10 is preferably symmetrical about a plane passing through a central axis 11. The compressor may also be largely symmetrical about a plane passing between the left side body and the right side body, and components on one side that do not have a counterpart on the opposite side may optionally be switched to the opposing side. The reference to left side and right side components should thus be understood for purposes of assisting in the description of this invention, and should not be construed as limitations.

A generally sleeved-shaped center body member 28 extends radially inward of the left side and the right side body members 22 and 24. A left end housing portion 30 and a similar right end housing portion 32, each generally also sleeve-shaped, are provided with respective body end closures 34 and 36 at opposing ends of the compressor for sealing engagement with one of the housing portions 30 and 32.

The compressor housing 14 includes a cooling flow line 38 therein, which in the depicted embodiment passes first through body member 22 to annular cavity 40, and then through discharge passageway 41 within body member 24 (discharge passageway 41 optionally being on the side circumferentially opposite from flow line 38). The lines 38 and 41, and the annular cavity 40, provide substantial cooling of the body 14 to keep the temperature of the compressor body within acceptable limits. A plurality of circumferentially spaced central flow ports 42 within central body 28 extends radially inward from annular cavity 40 to the exterior of the sleeve member 20 to assist in sealing reliability, as explained subsequently. Low pressure gas input line 44 in body 14 receives gas, and check valve 46 in line 44 prevents gas flow in the opposing direction. Another gas input line 48 and similar check valve 60 are provided on the right side of the compressor. A high pressure gas output line 52 outputs high pressure gas from the left side of the compressor, and check valve 54 in line 52 again serves to prevent reverse gas flow. A similar high pressure gas output line 56 and check valve 58 are provided on the right side of the compressor. A plurality of conventional O-ring seals or other sealing member 60 are provided between compressor components for either static or dynamic sealing engagement in a conventional manner.

The housing assembly 14 defines an elongate cylinder comprising cylinder chamber 64 radially inward of and defined by the left end housing portion 30, right end cylinder chamber 72 radially inward of and defined by the right end cylinder housing 32, and a central cylinder chamber extending between the left side and the right side chambers and defined by central housing body 28. Each of the chambers is preferably cylindrical in configuration and has a uniform diameter, although other chamber configurations could be provided. Note that the term "cylinder" as used herein means a chamber for slidably receiving a piston, and should not be construed as being limited to a chamber having a cylindrical configuration. The cross-sectional area of the central chamber is less than the cross-sectional area of each of the left side and right side chambers. Left side piston closure 16 is configured for sliding engagement with housing portion 30 within chamber 64, and right side piston closure 18 similarly is configured for sliding engagement with housing portion 72 within chamber 72. Center body 20 of the piston assembly slidingly engages the central housing portion 28, and dynamic sealing engagement between each of the respective members is provided with conventional seals 60. The center body 20 of the piston assembly thus has a diameter less than the diameter of each of the piston closure members 16 and 18.

The left side housing closure 34 includes a hydraulic input port 62 for passing hydraulic fluid into chamber 64, which hydraulic fluid acts on the face 17 of piston head 16. A restricted flow passageway 66 extends through the piston head 16 to the chamber or flow path 68 within the interior of the sleeve member 20. A similar input port 74 is provided within the right side housing closure 36 for inputting hydraulic fluid to chamber 72 to act on the face 19 of the piston head 18, and restricted flow passageway 70 within the piston head 18 is provided for communication between chamber 68 within the center body 20 and chamber 72.

The left side piston closure member 16 and the central housing portion 28 define an annular compression chamber 76 extending axially therebetween. The compression chamber 76 is radially inward of the left housing portion 30 and radially outward of the sleeve 20 of the piston assembly. The right side piston closure 18 and the central housing portion 28 similarly define an annular compression chamber 78 axially extending between these components, with chamber 78 being radially inward of the right side housing portion 32 and radially outward of the center body 20 of the piston assembly.

As the piston assembly moves left to right in response to increased hydraulic fluid pressure within chamber 64 and reduced hydraulic fluid pressure within chamber 72, the volume of the annular compression chamber 76 is substantially reduced. Compressed gas is thus discharged past check valve 54 and out flow line 52 as the volume of chamber 76 decreases. As the piston assembly moves left to right, low pressure gas is also drawn into the chamber 78 past the check valve 50. As the piston assembly moves right to left, the gas within the annular chamber 78 is compressed and is discharged past the check valve 58 and out line 56, while gas is drawn into the chamber 76 past the check valve 46.

The operation of the compressor system depicted in FIG. 1 will now be described. A four-way, two-position hydraulic control valve 80 receives pressurized hydraulic fluid, such as oil or air, from pump 82. Hydraulic fluid flows via line 88 through input port 62 and then to pressure chamber 64 to move the piston assembly 12 to the right. During this movement, hydraulic fluid in chamber 72 is passed through line 96 and line 86 to line 38 in the housing 14, through annulus 40 and line 41, and back to the pump through line 102. When the piston end closure contacts the center housing body 28, the pressure in line 88 will increase rapidly, causing the actuation of relief valve 114 to shift valve 80. Pressurized hydraulic fluid will then flow through line 96 and line 94 into chamber 72, while hydraulic fluid discharged from chamber 64 flows through line 88 and to line 86 to continue cooling of the compressor housing. Once the piston assembly is fully shifted and hydraulic fluid pressure increases, relief valve 114A returns the valve 80 to the position depicted in FIG. 1. Accumulators 112 and 112A, service valves 110 and 110A, and orifices or adjustable metering valves 116 and 116A serve to control the timing and sequencing of these operations. The above operation will continue as long as pressurized hydraulic fluid is applied to the compressor 10. A sensor 118 in gas discharge line 100 may be provided for automatically shutting off the pump 82 and thus deactivating the system once the gas pressure has reached a desired level. Heat exchanger 84 may be provided for effective cooling of the hydraulic fluid. Accumulator 83 is provided between the heat exchanger 84 and pump 82 to allow for make-up due to thermal expansion or contraction of the fluid, or due to leakage, while maintaining desired pressure of the pump suction. Gas optionally may be relieved from the system through a vent (not shown) provided on accumulator 83.

It should be noted that the same hydraulic fluid that is used to move the piston assembly 12 within the housing 14 is the fluid that flows through the housing to cool the housing. A central flow port 42 is provided through the center housing body 28 for passing fluid from the annular cavity 40 into engagement with the outer surface of the center body 20. This action provides lubrication to the O-ring seals carried on the center body member 28, thereby enhancing the reliability of sealing engagement between the center body 20 and the center body member 28 during reciprocation of the center body 20.

The system as illustrated in FIG. 1 is configured as a single-stage compressor, with both compressor cavities 76 and 78 drawing gas from a common low pressure source and discharging pressurized gas to a common high pressure source. The gas input lines 90 and 92 are thus each connected to low pressure source 91, while the discharge lines 98 and 100 are each connected to the high pressure gas storage container 99. In this mode, each cycle of the piston results in two suction strokes and two compression strokes to obtain high efficiency, although it should be apparent that the compressor would be operative if only one of the compressor chambers 76 or 78 were utilized to increase gas pressure. It should also be understood that the compressor can be configured as a two-stage compressor, with line 90 connected to a low pressure source 91, and the output from line 98 connected as an input to line 92, and the output from line 100 connected to the high pressure storage vessel. This configuration produces less volume of pressurized gas, but the gas may be compressed to a higher level. Regardless of the setup or configuration of the compressor, it should be understood that the hydraulic pressure within the chambers 64 and 72 may always be significantly less than the gas discharge pressure because of the area difference between the exposed face of the piston subjected to hydraulic pressure compared to the cross-sectional area of the respective annular compression chambers 76 and 78. Although this area difference may be easily regulated to a desired level, it is preferable that the area difference normally be at least 2:1 to obtain high compression ratios without allowing the hydraulic fluid to possibly contaminate the compressed gas.

Piston assembly 12 is also cooled by the flow of fluid through the piston assembly during its reciprocation within the housing 14, and this coolant is the same fluid used to drive the piston assembly. Piston head 16 includes a restricted flow passageway 66, so that increased pressure within chamber 64 causes fluid to flow through the passageway 66 and into chamber 68 within sleeve 20. The fluid within chamber 68 is free to pass out flow path 70 through head 18, so that a small quantity of fluid is passing through the piston assembly as it reciprocates left-to-right within the housing to cool the piston assembly. The fluid path 70 may also be a restricted flow passageway, so that fluid flows through the piston in the opposite direction when the valve 80 is shifted. The design of the compressor 10 substantially minimizes the spacing between the core gas at the geometric center of the compressed gas volume and a cooled metal surface. To maintain effective cooling, the compressed gas chamber 76 and 78 are preferably relatively thin chambers, and the flow path of chamber 68 within the sleeve 20 is comparatively large. Preferably, the wall thickness of the sleeve 20 is less than the interior radius of the sleeve 20, and, as previously noted, the face of the piston closure member on which the hydraulic fluid is acting is preferably twice the cross-sectional area of the corresponding compressed gas chamber.

Figure 2:
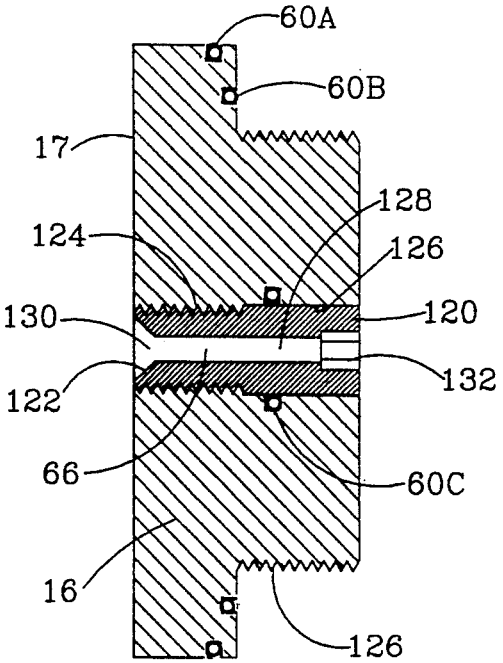
FIG. 2 is a detailed cross-sectional view of a compressor piston head according to the present invention.

FIG. 2 is a detailed view of a piston head or end closure 16 containing one or more O-ring or a specialty seal, or combination thereof (depending on the application) 60A for sealing engagement with the left end housing portion 30, and O-ring 60B for sealing engagement with the sleeve 20. Threads 126 may be provided on the head 16 for engagement with mating threads at the end of sleeve 20. A substantially cylindrical port 126 within the head is filled with insert 120. Insert 120 is connected to the body of the head by threads 124, and an O-ring seal 60C provides static sealing engagement between the insert 120 and the body of the head 16. Insert 120 has a passageway 66, which was generally discussed above. More particularly, the passageway 66 is formed with a frustroconical portion 122 adjacent the closure face 17 and radiused smoothly at the entrance to the passageway 66. The exit of the restricted passageway 66 interfacing with the chamber 68 is square edged so that fluid flow resistance from the compressor chamber to the flow path 68 within the sleeve 20 is less than fluid flow resistance from the path 68 to the compression chamber. The flow of hydraulic fluid through the piston assembly to cool the piston assembly increases as gas pressure increases in response to the additional hydraulic pressure required to move the piston assembly. Fluid flow through the piston assembly decreases process efficiency, but is substantially self-regulating.

The passageway through the piston head thus has a smooth, funnel, or nozzle-shaped entrance to reduce throttling losses that result in heat generation. Less pressure loss is encountered for fluid passing from the hydraulic chamber to the chamber 68 within the tube 20 than when fluid from the chamber 68 leaves the interior of the tube 20 and passes through the opposing passageway in the closure member, which has a sharp-edged entrance. A particular feature of the insert 120 as shown in FIG. 2 is to allow a gas compressor to be easily tailored to a particular use by removing the insert 120 and inserting a new insert that has a differently sized flow passageway therethrough. To assist in removal of the insert 120, an axially inward portion may have an increased cross-sectional area as shown at 132 to receive a conventional tool, such as an Allen wrench, to allow unthreading of the insert from the piston head once the respective housing end closure has been removed.

Figure 3:
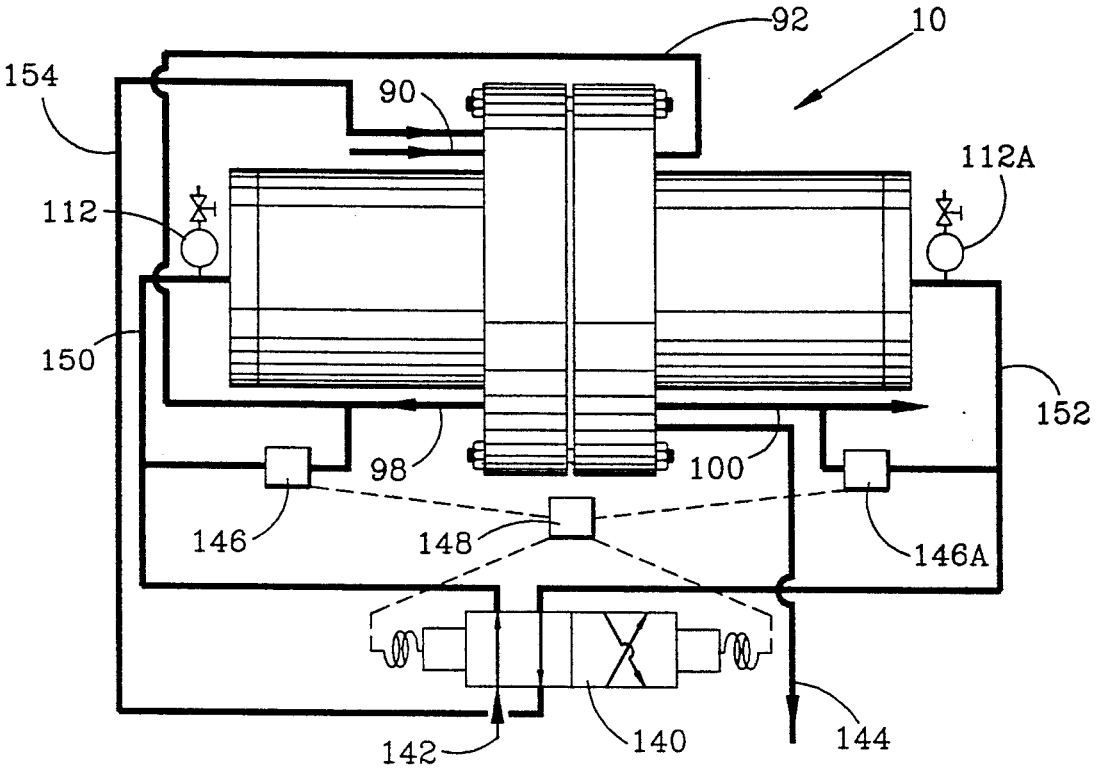
FIG. 3 is a schematic representation of an alternate compressor system according to this invention.

FIG. 3 discloses an alternate system of the present invention, with the same numerals used for like components for the system previously described. The compressor 10 is piped for high pressure gas generation, and accordingly output line 98 is connected to gas input line 100. The system uses a four-way, two-position solenoid operated shuttle valve 140 to operate the compressor 110 in a cyclic manner from a high pressure source (not shown). Hydraulic pressure is input to the system via line 142, and line 144 serves as a hydraulic return. Differential pressure sensors 146 and 146A transmit signals to central processing and control unit 140, which in turn regulates the solenoids at the opposing ends of control valve 140. Sensors 146, 146A and controller 148 operate in conjunction with the accumulators 112 and 112A to both regulate the timing or sequencing of the compressor shifting operation, and also assure that hydraulic pressure in the lines 150 and 152 and thus hydraulic pressure within the fluid chambers acting on the piston assembly does not exceed the generated gas pressure. Redundant seals and seals other than the O-ring type may optionally be used at each hydraulic fluid/gas interface seal location to further ensure that hydraulic fluid does not contaminate the compressed gas. The hydraulic fluid may also act as lubricating film for the hydraulic fluid/gas interface seals. Concerns about gas contamination and chemical reactions between the hydraulic fluid and the gas may be reduced by selecting an inert hydraulic fluid that has a low vapor pressure, such as a fluorinated oil sold by E.P. DuPont under the name KRYTOX 143.

The hydraulic fluid that is used to reciprocate the piston assembly for the compressor 10 as shown in FIG. 3 is the same fluid that is discharged from the compressor 10 during reciprocation of the valve assembly and is transmitted through line 154 to cool the valve housing in the manner previously described. It should be understood that cooling of the compressor housing or body can be accomplished from a source that is separate from the hydraulic fluid used to reciprocate the piston assembly, although the system as discussed above has advantages of simplicity and low cost.

The gas compressor described above is preferred since this design ensures that each of the left end and right end chambers will have a cross-section greater than the cross-section of the respective gas compression chambers, and accordingly the hydraulic fluid pressure will be greater than the gas pressure to ideally minimize contamination of the compressed gas by the hydraulic fluid. Moreover, as previously explained, this cross-sectional area difference can easily be controlled to be greater than 2:1, which both reduces the risk of gas contamination and reduces the spacing between the core gas and a cooled metal wall surface to control the maximum temperature of the compressed gas. An alternative compressor design (not shown in the figures) would have a housing defined by a left end and a right end chamber each having a cross-sectional area less than that of a center chamber, and utilizing a piston comprising a uniform diameter tube, end closures at each end of the tube having a restricted flow passageway therein, and donut-shaped center body. The outer cylindrical surface of the donut-shaped body would then sealingly engage the larger diameter center chamber, while the end closures would seal with the smaller diameter left and right end chambers, respectively. The annular first and second gas compression chambers would thus each be spaced axially between the donut-shaped body on the piston and the respective left end housing portion and right end housing portion, radially outward of the uniform diameter tube, and radially inward of the center housing portion. A disadvantage of this embodiment is that the size of the chambers must be controlled to ensure that hydraulic pressure remains less than gas pressure to minimize contamination, since the cross-sectional area of the compression chambers for this embodiment could be greater than the cross-sectional area of the hydraulic chambers.

Flow through the piston assembly as described above is ideal for cooling the piston assembly with the hydraulic fluid used to reciprocate the piston assembly. For certain applications, flow through the piston assembly may not be critical, particularly if the annular compression chambers are relatively thin, i.e., a small spacing is provided between the outer surface and inner surface of the annular compression chambers. Each end cap may be fabricated with a restricted through passageway as shown in FIG. 2, such that fluid flow is under a lower flow restriction from the respective compression chamber into the flow path within the center body of the piston, and under a higher flow resistance from the center body out the opposing end cap. Only one restricted flow passageway may be required, however, and the opposing end cap could have a substantially unrestricted flow path therein. This latter embodiment may result in throttling of fluid flow entering the chamber 68 through the piston head during substantially only one-half of the full stroke of the piston, thus limiting the heat added to the fluid due to throttling flow during that time interval, but overall facilitating the maintaining of the piston assembly at a desired temperature level and simplifying manufacturing of gas compressor components.

Various control valves may be used for selectively regulating flow of hydraulic fluid to one of the left and right hydraulic input ports of the compressor, and the hydraulic valve and solenoid valve disclosed herein should be understood as being exemplary of a suitable control valve. A relief valve 114 is also a suitable pressure sensor responsive to hydraulic fluid pressure for activating the control valve 140, although those skilled in the art will appreciate that other types of pressure sensors may be used for sensing the increase in hydraulic pressure when the piston assembly reaches the end of its stroke, and activating the control valve in response thereto. Similarly, various forms of a pressure switch 118 may be provided that are responsive to the gas pressure output from the compressor for controlling hydraulic fluid flow to the compressor. As previously noted, the compressor of the present invention may utilize the discharge fluid from the non-pressurized hydraulic chamber as the input to the cooling flow line for passing hydraulic fluid through the compressor housing, although hydraulic fluid for cooling the compressor housing may be withdrawn from various locations within the hydraulic fluid system, or an entirely different coolant may be used for cooling the compressor housing.

Further modifications of the invention should be apparent from the foregoing disclosure, and are considered within the concept of the present invention. It should thus be understood that the embodiments described above and illustrated in the accompanying drawings are provided for illustration only, and the invention is not limited to these embodiments. Other embodiments and operating procedures will be suggested from this disclosure, and may be made without departing from the spirit of the invention.

What is claimed is:

1. A hydraulically powered gas compressor for receiving a low pressure gas and outputting a high pressure gas, the gas compressor comprising:

a compressor housing assembly having a left end housing portion, a right end housing portion, and a center housing portion, the compressor housing defining an elongate cylinder having a respective left end chamber, an opposing right end chamber, and a center chamber axially spaced between the left end chamber and the right end chamber;

the center chamber of the cylinder having a cross-sectional area less than the cross-sectional area of each of the left end chamber and the right end chamber;

a piston assembly axially movable within the elongate cylinder, the piston assembly having a left end closure with a left end face, a right end closure with a right end face, and a center body axially spaced between the left end closure and the right end closure;

the center body of the piston assembly having a cross-sectional area less than the cross-sectional area of each of the left end closure and the right end closure, the left end closure slidably movable within the left end chamber, the right end closure slidably movable within the right end chamber, and the center body slidably movable within the center chamber;

a left end hydraulic input port for inputting pressurized hydraulic fluid to the left end chamber for acting on the left end face of the piston assembly;

a right end hydraulic input port for inputting pressurized hydraulic fluid to the right end chamber for acting on the right end face of the piston assembly;

the left end closure of the piston assembly and the center housing portion of the compressor housing defining a first annular compression chamber radially inward of the left end housing portion and radially outward of the center body of the piston assembly;

the right end closure of the piston assembly and the center housing portion of the compressor housing defining a second annular compression chamber radially inward of the right housing portion and radially outward of the center body of the piston assembly;

the compressor housing having a first gas input line extending to the first annular compression chamber and a first gas output line from the first annular compression chamber; and the compressor housing having a second gas input line extending to the second compression chamber and a second gas output line from the second annular chamber.

2. The gas compressor as defined in claim 1, further comprising:

at least one of the left end closure and the right end closure of the piston assembly having a restricted flow passageway therethrough, the other of the left end closure and the right end closure having a flow port therethrough, and the center body of the piston assembly having a flow path extending between the restricted passageway and the flow port, such that hydraulic fluid flow through the piston assembly cools the piston assembly.

3. The gas compressor as defined in claim 2, further comprising:

the restricted flow passageway being within the left end closure, and the flow path within the right end closure defining another restricted passageway; and the center body of the piston assembly being a sleeve member having a wall thickness less than the interior radius of the sleeve member.

4. The gas compressor as defined in claim 2, further comprising:

the restricted flow passageway having a closure face cross-sectional area greater than the cross-sectional area of a closure interior portion of the restricted flow passageway, such that fluid flow resistance of the hydraulic fluid from the left end chamber to the center body flow path is less than fluid flow resistance of the hydraulic fluid from the center body flow path to the right end chamber.

5. The gas compressor as defined in claim 1, further comprising:

the center housing portion having a central flow port extending into fluid engagement with the center body of the piston assembly to enhance sealing reliability between the center housing portion and the piston assembly.

6. The gas compressor as defined in claim 5, wherein:

the center port within the center housing portion is in fluid communication with the hydraulic fluid.

7. The gas compressor as defined in claim 1, further comprising;

each of the first gas input line and the second gas input line being in fluid communication with a common low pressure source; and each of the first gas output line and the second gas output line being in fluid communication with a common high pressure source.

8. The gas compressor as defined in claim 1, further comprising:

the first gas input line being in fluid communication with a low pressure source;

the first gas output line being in fluid communication with the second gas input line; and the second gas output line being in fluid communication with a high pressure source.

9. The gas compressor as defined in claim 1, wherein:

the cross-sectional area of the left end chamber and the right end chamber is at least twice the cross-sectional area of the respective first annular compression chamber and the right annular compression chamber.

10. The gas compressor as defined in claim 1, further comprising:

the compressor housing including a cooling flow line therethrough for passing the hydraulic fluid to cool the compressor housing.

11. A hydraulically powered gas compressor for receiving a low pressure gas and outputting a high pressure gas, the gas compressor comprising:

a compressor housing assembly having a left end housing portion, a right end housing portion, and a center housing portion, the compressor housing defining an elongate cylinder having a respective left end chamber, an opposing right end chamber, and a center chamber axially spaced between the left end chamber and the right end chamber;

the center chamber of the cylinder having a cross-sectional area distinct from the cross-sectional area of each of the left end chamber and the right end chamber;

a piston assembly axially movable within the elongate cylinder, the piston assembly having a left end closure with a left end face, a right end closure with a right end face, and a center body axially spaced between the left end closure and the right end closure;

the center body of the piston assembly having a cross-sectional area distinct from the cross-sectional area of each of the left end closure and the right end closure, the left end closure slidably movable within the left end chamber, the right end closure slidably movable within the right end chamber, and the center body slidably movable within the center chamber;

a left end hydraulic input port for inputting pressurized hydraulic fluid to the left end chamber for acting on the left end face of the piston assembly;

a right end hydraulic input port for inputting pressurized hydraulic fluid to the right end chamber for acting on the right end face of the piston assembly;

a first annular compression chamber defined by the center housing portion, the left end housing portion, and the piston assembly;

a second annular compression chamber defined by the center housing portion, the right end housing portion, and the piston assembly;

the compressor housing having a first gas input line extending to the first annular compression chamber and a first gas output line from the first annular compression chamber;

the compressor housing having a second gas input line extending to the second compression chamber and a second gas output line from the second annular chamber; and at least one of the left end closure and the right end closure of the piston assembly having a restricted flow passageway therethrough, the other of the left end closure and the right end closure having a flow port therethrough, and the center body of the piston assembly having a flow path extending between the restricted passageway and the flow port, such that hydraulic fluid flow through the piston assembly cools the piston assembly.

12. The gas compressor as defined in claim 11 wherein:

the restricted flow passageway being within the left end closure, and the flow path within the right end closure defining another restricted passageway.

13. The gas compressor as defined in claim 11 further comprising:

the restricted flow passageway having a closure face cross-sectional area greater than the cross-sectional area of a closure interior portion of the restricted flow passageway, such that fluid flow resistance of hydraulic fluid from the left end compressor chamber to the center body flow path is less than fluid flow resistance of hydraulic fluid from the center body flow path to the right end compression chamber.

14. The gas compressor as defined in claim 11 wherein:

the cross-sectional area of the left end chamber and right end chamber is greater than the cross-sectional area of the respective first annular compression chamber and the second annular compression chamber, such that gas pressure is greater than hydraulic pressure.

15. The gas compressor as defined in claim 11, further comprising:

the first gas input line being in fluid communication with a low pressure source;

the first gas output line being in fluid communication with the second gas input line; and the second gas output line being in fluid communication with a high pressure source.

16. The gas compressor as defined in claim 11 further comprising:

the compressor housing including a cooling flow line therethrough for passing the hydraulic fluid to cool the housing.

17. A system for utilizing pressurized hydraulic fluid to convert a low pressure gas to a high pressure gas, the system comprising:

(a) a compressor including a compressor housing assembly having a left end housing portion, a right end housing portion, and a center housing portion, the compressor housing defining an elongate cylinder having a respective left end chamber, an opposing right end chamber, and a center chamber axially spaced between the left end chamber and the right end chamber;

the center chamber of the cylinder having a cross-sectional area distinct from the cross-sectional area of each of the left end chamber and the right end chamber;

a piston assembly axially movable within the elongate cylinder, the piston assembly having a left end closure with a left end face, a right end closure with a right end face, and a center body axially spaced between the left end closure and the right end closure;

the center body of the piston assembly having a cross-sectional area distinct from the cross-sectional area of each of the left end closure and the right end closure, the left end closure slidably movable within the left end chamber, the right end closure slidably movable within the right end chamber, and the center body slidably movable within the center chamber;

a left end hydraulic input port for inputting pressurized hydraulic fluid to the left end chamber for acting on the left end face of the piston assembly;

a right end hydraulic input port for inputting pressurized hydraulic fluid to the right end chamber for acting on the right end face of the piston assembly;

a first annular compression chamber defined by the center housing portion, the left end housing portion, and the piston assembly;

a second annular compression chamber defined by the center housing portion, the right end housing portion, and the piston assembly;

the compressor housing having a first gas input line extending to the first annular compression chamber and a first gas output line from the first annular compression chamber; and the compressor housing having a second gas input line extending to the second compression chamber and a second gas output line from the second annular chamber;

(b) a control valve for selectively regulating flow of hydraulic fluid to one of the left and the right hydraulic input ports; and (c) a pressure sensor responsive to hydraulic fluid pressure for activating the control valve.

18. The gas system as defined in claim 17, wherein the compressor further comprises:

at least one of the left end closure and the right end closure of the piston assembly having a restricted flow passageway therethrough, the other of the left end closure and the right end closure having a flow port therethrough, and the center body of the piston assembly having a flow path extending between the restricted passageway and the flow port, such that hydraulic fluid flow through the piston assembly cools the piston assembly.

19. The system as defined in claim 18, further comprising:

the compressor housing including a cooling flow line therethrough for passing hydraulic fluid to cool the compressor housing; and hydraulic fluid discharged from one of the left end chamber and the right end chamber being input to the cooling flow line.

20. The system as defined in claim 17, further comprising:

a pressure switch responsive to gas pressure for controlling hydraulic fluid flow to the compressor.

21. The system as defined in claim 17, wherein the compressor further comprises:

the cross-sectional area of the left end chamber and right end chamber being greater than the cross-sectional area of the respective first annular compression chamber and the second annular compression chamber, such that gas pressure is greater than hydraulic pressure.

22. The system as defined in claim 17, further comprising:

each of the first gas input line and the second gas input line being in fluid communication with a common low pressure source; and each of the first gas output line and the second gas output line being in fluid communication with a common high pressure source.

23. The gas system as defined in claim 17, further comprising:

the first gas input line being in fluid communication with a low pressure source;

the first gas output line being in fluid communication with the second gas input line; and the second gas output line being in fluid communication with a high pressure source.

* * * * *